United States Patent [19]

Nagaoka et al.

[11] 4,381,436

[45] Apr. 26, 1983

[54] ROTARY ARC TYPE CIRCUIT BREAKER

[76] Inventors: Yoshifumi Nagaoka; Kanji Morishima; Hiromi Ishii, all c/o Nissin Electric Co., Ltd., 47 Umezu-Takase-cho, Ukyo-ku, Kyoto, 615, Japan; Georges Bernard, 24, rue de la Richarde, 38120 St. Egreve, France

[21] Appl. No.: 162,595

[22] Filed: Jun. 24, 1980

[30] Foreign Application Priority Data

Jul. 2, 1979 [JP] Japan ..... 54-91828[U]

[51] Int. Cl.[3] ..... H01H 33/88

[52] U.S. Cl. ..... 200/148 A; 200/148 R; 200/150 G

[58] Field of Search ..... 200/148 A, 150 G, 148 R

[56] References Cited

U.S. PATENT DOCUMENTS 2,246,171 6/1941 Grosse ..... 200/148 A 4,182,942 1/1980 Koyanagi et al. ..... 200/150 G

FOREIGN PATENT DOCUMENTS 1540177 1/1970 Fed. Rep. of Germany ... 200/148 A

*Primary Examiner*—Robert S. Macon

*Attorney, Agent, or Firm*—Stevens, Davis, Miller & Mosher

[57] ABSTRACT

Gas-blast circuit interrupter having a gas-blast aspiration device for interrupting small currents and a magnetic blowout device which causes rotation of the arc and/or a gas blasting device by the thermal expansion of the gas in the arc-extinguishing chamber towards an expansion chamber for interrupting high currents about some hundred amperes.

5 Claims, 6 Drawing Figures

ROTARY ARC TYPE CIRCUIT BREAKER

The invention relates to a gas-blast circuit interrupter having a gas-tight enclosure comprising a pair of separable contact members and a partition wall dividing the interior of the enclosure into two chambers, an arc-extinguishing chamber and an expansion chamber. A tubular movable nozzle shaped contact passes through an orifice provided in the partition wall for establishing a communication between the two chambers.

A known circuit interrupter of this kind comprises a magnetic blow-out coil which causes rotation of the arc drawn between the separated contacts. The blow-out coil is energized by the current flowing in the interrupter and the magnetic field produced by the coil when the current is small, for instance less than hundred amperes, does not provide a rotation and an extinction of the arc.

It is an object of the present invention to provide a gas blast circuit interrupteur having a small energy driving mechanism and having means for the efficient blasting of the arc.

According to the invention, the circuit interrupter further comprises a gas aspiration device producing a blasting of arc-extinguishing gas (such as sulfur hexafluoride, against an arc drawn between a pair of separable contact members for interrupting small currents.

Another object of the invention is to provide a circuit interrupter of simple construction having a partition wall providing an electrical connection to the movable contact.

It is another object of the invention to provide a circuit interrupter having improved characteristics for the flow of the blast of arc-extinguishing gas. The gas flow is increased by the thermal expansion of the gas in the arc-extinguishing chamber which escapes towards the expansion chamber.

The invention will now be described with reference to the attached drawings which show in diagrammatic form some embodiments of the circuit interrupter according to the invention.

Figure 1:
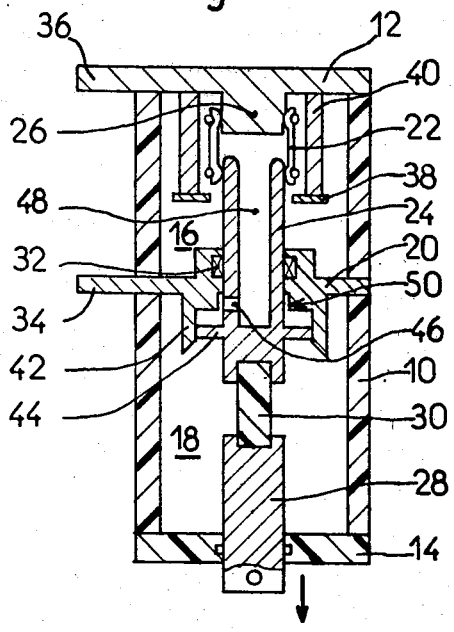
FIG. 1 is an axial section of a circuit interrupter according to the invention, the interrupter being shown in the closed circuit position.
Figure 2:
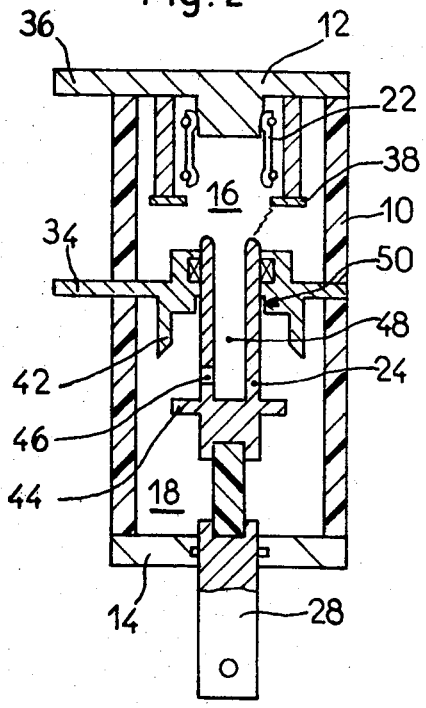
FIG. 2 shows the interrupter of FIG. 1 in the separated open position.

In FIGS. 1 and 2, the closed casing of the interrupter or circuit-breaker is defined by a cylindrical envelope 10 of insulating material, a cover 12 of conductive material and a bottom 14 of insulating or conductive material. The casing is filled with an arc-extinguishing gas such as sulfur hexafluoride SF6 of a suitable pressure. A fixed partition wall 20, which can be of conductive material, fixed on the envelope 10, divides the interior of the casing into two chambers, one chamber 16, between cover 12 and wall 20, of constant volume, called arc extinguishing chamber and one chamber 18, of constant volume, called expansion chamber. The partition wall 20 is pierced for the formation of an orifice for the gas-tight passage of a cylindrical tubular movable contact 24. The cover 12 carries a fixed contact 22 provided with a plurality of axially extending circumferentially spaced-apart contact fingers secured on a fixed appendix 26 of cover 12 and adapted to slidingly receive the end portion of the movable contact member 24 during the closing movement of the contacts. A solid insulating portion 30 insulates the control rod 28 of the movable contact member 24 and the end portion of the rod 28 passes with interposition of a seal ring through an orifice provided in the bottom 14 and is linked to a driving mechanism (not shown). The partition wall 20 carries on the one hand a current pickup contact 32 which cooperates with the movable contact member 24 and on the other hand an external line terminal connection 34 extending through the envelope 10. The cover 12 carries a line terminal connection 36 and it is easy to see that in the closed circuit position of the contacts shown in FIG. 1 the current enters the interrupter through the line terminal connection 34, flows then through the cover 12, the fixed contact member 22, the movable contact member 24, the pick-up contact 32, the partition wall 20 and leaves the interrupter through the line terminal connection 34. A fixed annular arcing electrode 38 is disposed in the arc extinguishing chamber 16 in surrounding relation with respect to the tubular movable contact 24 in the closed engaged position and is electrically and mechanically connected by a suitable connection member 26 to the cover 12 so that an arc drawn between the contacts 22, 24 is rapidly switched over from the fixed contact 22 on the annular electrode 38 avoiding excessive burning at the fixed contact 22.

According to the present invention the partition wall 20 carries a cylinder 42 which is disposed in the expansion chamber 18 in surrounding relation with respect to the tubular movable contact 24 and has an open end face directed towards the bottom 14. A piston 44 which is attached and movable with the movable contact 24 slides in sealing relation in the interior of the cylinder 42 during the initial phase of the opening movement of the movable contact 24. The movable contact 24 is provided with an opening 46 establishing a communication between the interior 48 of the venting contact 24 and the interior of the cylinder 42 during the above mentioned initial phase and between the interior 48 of the contact 24 and the expansion chamber 18 when the piston 44 has leaved and slides outsides the cylinder 42. In the closed circuit position of the tubular movable contact the opening 46 faces a recess 50 arranged in the partition wall 20 so as to provide a communication between the arc extinguishing chamber 16 and the cylinder 42 by means of the interior 48 of the movable venting contact 24. If the movable contact 24 is actuated to the open circuit position the piston 44 slides along the wall of the cylinder 42 to increase the volume of the space included between the movable piston 44 and the fixed partition wall 20 and a flow of gas is set up issuing from the arc-extinguishing chamber 16 and directed through the tubular movable contact 24 which forms a nozzle, towards the cylinder 42. After the stroke 1 of the movable contact 24 the piston 44 leaves the cylinder 42.

The interrupter operates in the following manner:

In the closed circuit position, shown in FIG. 1, the piston 44 is engaged in the cylinder 42 and the suction volume included between the piston 44 and the wall 20 is minima. A movement of the operating rod 28 in the direction of the arrow causes the down stroke of the movable contact member 24 and of the piston 44. The contacts 22, 24 separate and draw an arc between the end portions thereof in the vicinity of the electrode 38 on which the arc is switched over. The piston 44 slides downwards and aspirates extinguishing gas from the arc extinguishing chamber 16 towards the cylinder 42 to permit a radial blast of the arc. The blasting is instantaneous from the very instant of separation of the contacts 22, 24. This blasting remains during the initial phase of the opening movement. After this initial phase, corresponding to the stroke 1 of the piston 44, the latter disengages from the cylinder 42 and the venting passage 46, 48 provides a direct communication between the arc extinguishing chamber 16 and the expansion chamber 18. The compression hot gas in the arc extinguishing chamber 16 is caused to discharge through the tubular movable contact towards the expansion chamber 18 providing a blast of the arc of high velocity when the arc current and therefore the gas heating are high. When the interrupter interrupts a small current, about some ten or hundred amperes, the arc-extinction occurs during the initial opening stroke. At the higher current values of some hundred or thousand amperes, the gas blast as well as the contact spacing are too small to bring about the arc extinction during the initial phase. The extinguishing gas heated by the action of the arc in the arc extinguishing chamber 16 discharges towards the expansion chamber when the communication 46, 48 is opened by the disengagement of piston 44. The mild blast of gas during the initial phase is rapidly increased to achieving arc extinction.

It will be noted that an interrupter having only an arc blasting device acting by the thermal expansion of the arc extinguishing gas could not interrupt small currents. Further an interrupter having only an arc blasting device providing a gas aspiration by piston 44, cylinder 42 should require a cylinder of an excessive size for blasting high power currents. The aspiration arrangement, piston 44, cylinder 42 permits to obtain from the very instant of the contact movement a mixture pressure difference between the arc-extinguishing chamber 16 and the cylinder 42 to achieve a flow of gas through the movable contact nozzle. The aspiration device 42, 44 does not delay the interruption of high currents and it starts the blast flow through the tubular venting contact 24. The mechanical driving energy of the interrupter may be maintained at a low value while the interrupting capabilities are increased.

In the following figures, the same reference numbers are employed to designate parts similar or identical to those shown in FIGS. 1 and 2, and these parts will not be described again in detail below.

Figure 3:
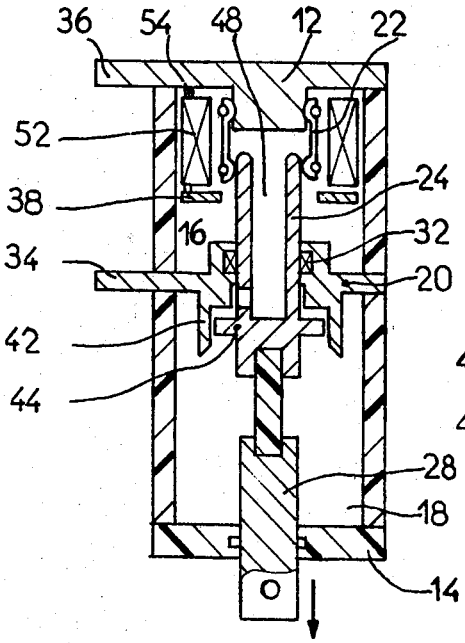
FIGS. 3 and 4 illustrate another embodiment of the invention in positions similar to that shown in FIGS. 1 and 2.
Figure 4:
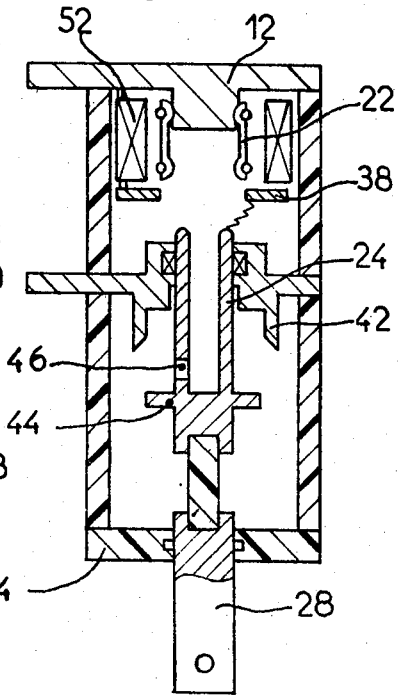
Figure 5:
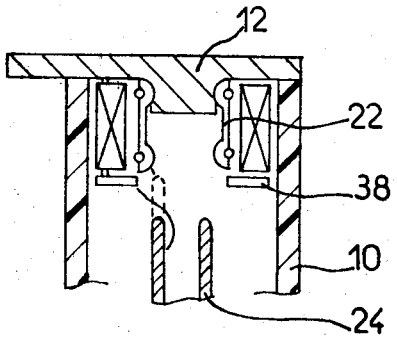
FIG. 5 is a partial view of the interrupter of FIGS. 3 and 4, shown at the start of its opening.

In FIGS. 3 to 5, which illustrate another embodiment of the invention, the piston 44, cylinder 42 gas aspiration device and the thermal gas expansion device are identical to those of FIGS. 1 and 2. A field coil 52 is disposed in the arc-extinguishing chamber 16 in surrounding relation with respect to the fixed contact 22. One end of the coil 52 is electrically connected by means of a conductor 54 to the cover 12 and the other end is connected to the annular electrode 38. If the movable contact member 24 is actuated to the open circuit position the arc drawn between the contacts 22, 24 is rapidly transferred to the electrode 38 in the above described manner and the coil 52 will be energized to establish a radial magnetic field across the arc gap between the electrode 38 and the end portion of the movable contact 24 (FIG. 5). The arc is thus caused to move rapidly over the annular surfaces of electrode 38 and contact 24 and at such a rate which avoids burning of the arc terminal surfaces. The arc rotation in the extinguishing chamber 16 increases the gas heating and therefor the thermal expansion of the gas which produces the gas blast towards the expansion chamber after freeing of the venting communication. The magnetical arc blast enhances the deionizing action and higher currents may be interrupted without increasing the actuating mechanism energy. The interrupting of small currents occurs in the same manner to that described in connection with FIGS. 1 and 2, the arc rotation avoiding burning of the contacts.

Figure 6:
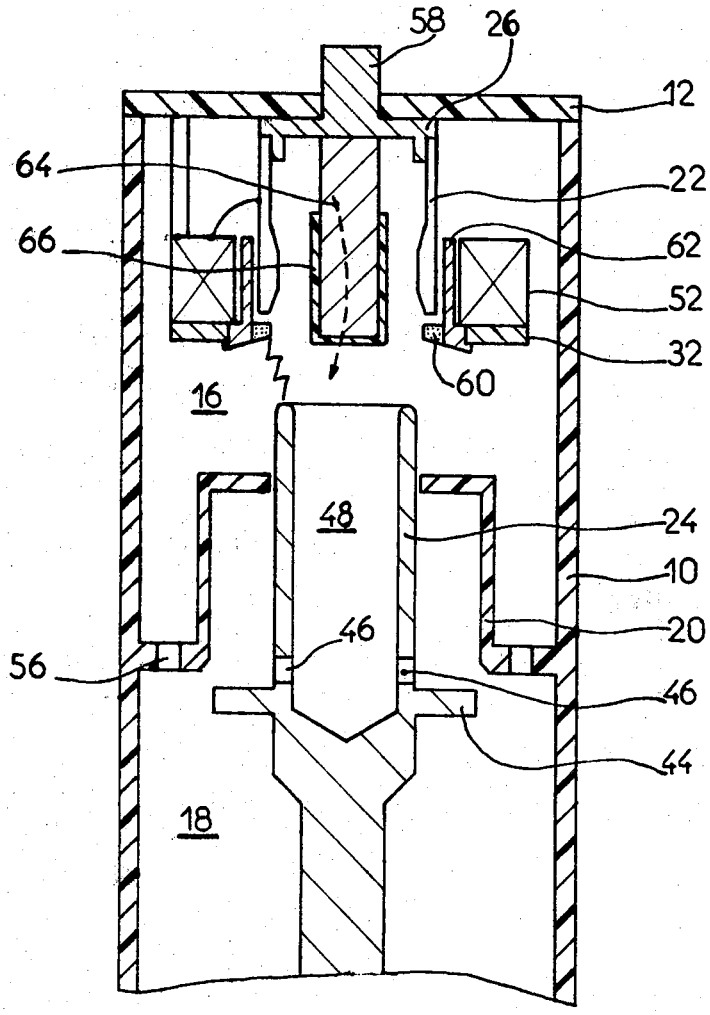
FIG. 6 illustrates still another embodiment of the invention.

In FIG. 6, an interrupter of somewhat different form is shown. In this arrangement the partition wall 20 of insulating material is provided with openings 56 establishing a communication between the arc extinguishing chamber 16 and the expansion chamber 18. The cover 12 of insulating material bears a lead-through terminal 58 and the coil 52 is electrically connected to the fixed contact 22 and to the annular electrode 32. The electrode 32 is provided with an inner arcing ring 60 and a screen 62 extends between the inner face of coil 52 and the fixed contact 22. A core 64 of ferromagnetic material extends axially insides the fixed contact 22 and has its front end covered by a cap 66 of insulating material. A not shown sliding contact cooperates with the rear part of the tubular movable contact but the electrical connection may be of the kind shown in FIGS. 1 to 5 or of another well known type. The core 64 increases the magnetic blast field produced by the coil 52.

Il will be realized that the arc blasting by the thermal expansion of the gas in the arc extinguishing chamber 16 is slight, the main part of the compressed gas escaping through the openings 56 directly towards the expansion chamber 18. Small currents are interrupted in the above mentioned manner by the gas aspiration produced by piston 44, cylinder 42, while high currents are interrupted by the arc rotation.

It is of course possible to equip the interrupter of FIGS. 3 to 5 with a partition wall and a coil of the kind shown in FIG. 6 and inversely. Further a permanent blow-magnet may be used in place of the blow-coil.

What is claimed is:

1. A gas-blast circuit interrupter comprising:

a gastight enclosure containing an arc extinguishing gas, a pair of contact members axially separable to draw an arc between the end portions of said contact members, one of said contact members being tubular and movable, a partition wall dividing the enclosure into two chambers of constant volume, an arc extinguishing chamber and an expansion chamber, an opening provided in the partition wall for the gas tight passage of the tubular movable contact, a gas aspiration device having a piston and a cylinder cooperating so as to produce a flow of gas through said tubular contact and a blast of gas directed towards said arc, an opening provided in the tubular movable contact for establishing a communication between the interior of the tubular contact and said gas aspiration device during an initial phase of the opening movement of the contacts and a communication between the interior of the tubular contact and the expansion chamber during the further phase of the opening movement thereby permitting a flow of blast gas through the tubular contact towards the gas aspiration device during said initial phase and towards the gas expansion chamber after said initial phase.

2. A gas-blast circuit interrupter according to claim 1, said cylinder being secured to the partition wall and having an open end portion disposed in the expansion chamber, the piston secured to the tubular movable contact being engaged and movable in the cylinder in the said initial phase and being disengaged from said cylinder after this initial phase.

3. A gas-blast circuit interrupter according to claim 1, comprising a partition wall being of conducting material and a sliding contact supported by the partition wall and cooperating with said tubular movable contact.

4. A gas-blast circuit interrupter according to claim 1, comprising a coil disposed in the arc extinguishing chamber in surrounding relation with respect to said contacts being in the closed position, an annular electrode surrounding said contacts so that the arc drawn by the separation of the contacts is transfered to the electrode and electrical connection means for energizing said coil when the arc is transfered to the electrode for driving said arc in rotation.

5. A gas-blast circuit interrupter according to claim 4, the volume of said arc extinguishing chamber being smaller than the volume of said expansion chamber.

* * * * *